US011926395B2

(12) United States Patent
McCracken

(10) Patent No.: US 11,926,395 B2
(45) Date of Patent: Mar. 12, 2024

(54) SURFBOARD WITH LOW-PROFILE PROPULSION SYSTEM

(71) Applicant: Andrew McCracken, Santa Maria, CA (US)

(72) Inventor: Andrew McCracken, Santa Maria, CA (US)

( * ) Notice: Subject to any disclaimer, the term of this patent is extended or adjusted under 35 U.S.C. 154(b) by 373 days.

(21) Appl. No.: 17/355,145

(22) Filed: Jun. 22, 2021

(65) Prior Publication Data

US 2022/0017185 A1 Jan. 20, 2022

Related U.S. Application Data

(60) Provisional application No. 63/042,567, filed on Jun. 23, 2020.

(51) Int. Cl.

| | |
|---|---|
| ***B63B 32/10*** | (2020.01) |
| ***B63B 32/50*** | (2020.01) |
| ***B63B 32/60*** | (2020.01) |
| ***B63H 1/14*** | (2006.01) |
| ***B63H 21/17*** | (2006.01) |
| ***B63H 21/21*** | (2006.01) |
| ***B63H 23/34*** | (2006.01) |

(52) U.S. Cl.

CPC ..... *B63B 32/10* (2020.02); *B63B 32/50* (2020.02); *B63B 32/60* (2020.02); *B63H 1/14* (2013.01); *B63H 21/17* (2013.01); *B63H 21/213* (2013.01); *B63H 23/34* (2013.01)

(58) Field of Classification Search

CPC ..... B63B 32/10; B63B 32/50; B63B 32/60; B63H 1/14; B63H 21/17; B63H 21/213; B63H 23/34

See application file for complete search history.

(56) References Cited

U.S. PATENT DOCUMENTS

| | | | | |
|---|---|---|---|---|
| 8,702,458 | B2 * | 4/2014 | Preston | B63B 32/10 441/74 |
| 2011/0111650 | A1 | 5/2011 | Braden et al. | |
| 2013/0157526 | A1 | 6/2013 | Martin | |
| 2021/0347442 | A1 * | 11/2021 | Montague | B63B 32/40 |

* cited by examiner

*Primary Examiner* — Andrew Polay
(74) *Attorney, Agent, or Firm* — Sierra IP Law, PC; William K. Nelson

(57) ABSTRACT

Conventional surfboards enable a rider to catch a wave and ride towards the shoreline while utilizing the power of the ocean to enjoy the ocean waves uniquely. A low-profile motorized surfboard has been developed to assist riders who may have a disability or struggle to get into the position necessary to begin riding the waves. The surfboard may comprise at least one propeller and electromechanical motor, which may provide propulsion for the rider. The surfboard may have an internal power system and supporting circuitry for safe and reliable propulsion. The motorized surfboard may have a low-profile system that is collapsible and allows for the rider to enjoy the surf as if the surfboard were a conventional system. The system may also function to return the rider to the shoreline.

20 Claims, 6 Drawing Sheets

SURFBOARD WITH LOW-PROFILE PROPULSION SYSTEM

FIELD OF THE INVENTION

The present invention relates to a surfboard with a low-profile propulsion system and a method, apparatus, and system for controlling the propulsion system.

DISCUSSION OF THE BACKGROUND

Conventional surfboards enable riders to catch and ride waves towards a shoreline and experience the thrill and power of ocean waves. However, to catch a wave, the surfer must first paddle through the surf zone and out to the point where the waves begin to form crests that can be caught and ridden. Once the rider is in a suitable position to catch an incoming wave, the rider must quickly accelerate to catch the wave as it passes the rider. Such activities are both time consuming and exhausting and require the rider to have considerable upper body strength to pass through the surf zone to reach the waves, and then to rapidly accelerate and catch a wave. Accordingly, persons who have suffered injuries or impairments which limit their ability to paddle are effectively prevented or at least impaired from enjoying this activity. Similarly, novice riders often lack the necessary combination of strength and skill to catch waves.

Powered surfboards have been previously developed to provide methods of propulsion and overcoming the surf, but the systems used to achieve propulsion are large and bulky and interfere with a rider's ability to use the surfboard in a conventional manner. The systems put significant amounts of drag on the hull of the surfboard, which interferes with the maneuverability of riding the wave. To overcome the shortcomings of drag, a low-profile system of propulsion is needed, where low-profile may reduce the drag and allow for the surfer to ride the powered surfboard as a traditional surfboard.

A motorized surfboarding device that does not interfere with the natural feel of a conventional surfboard is desired; the system should be low-profile, lightweight, and facilitate overcoming the surf zone with propulsion.

SUMMARY OF THE INVENTION

The present invention provides a motorized surfboard operable to assist a rider in overcoming the surf zone to prevent the rider from reaching physical exhaustion, while maintaining the body profile of a conventional surfboard without bulky components. The device of the present invention is a manufacture surfboard with various circuits and components to help beginners and elder riders, which exhaust rapidly to overcome staging to ride a wave.

The low-profile motorized surfboard of the present invention includes at least one electro-mechanical motor and propeller assembly which is nested in a surfboard having an interior cavity for storing electrical power and circuitry. A power controller is included and operable to electrically control the electromechanical motor and propeller system. The body of the surfboard may be comprised of an interior material (e.g., fiberglass, foam, carbon, etc.) and exterior material. A battery system may be provided to power the control circuitry and the DC motors. The control circuitry may be comprised of a microcontroller, accelerometer, a brushless speed controller (e.g., ESC), and a Bluetooth transmitter. The control circuitry may be stored in a water-sealed compartment that is flush with the body to prevent additional drag on the system.

In some embodiments, a handheld controller is operable to control the system wirelessly. The microcontroller is operable to determine the charge of the battery system and transmit a command to the handheld controller. The handheld controller may have various LEDs (e.g., light-emitting diodes) that may display the current charge of the system, additionally, the controller may have a button to control the throttle position of the DC motors.

In some embodiments of the present invention, the motorized surfboard has a low-profile propeller that is fixed to the driveshaft and may thrust the surfboard forward. The low-profile propeller may have a pitch that is variable or fixed and may have numerous blades. The In some embodiments, the motorized surfboard system that is only in operation to assist the rider passing the surf zone and a braking system that initiates a drag force applied at the outlet of the thrust.

In another design of the motorized surfboard, the motorized driving system alternatively has an internal a water jet propulsion system that includes an inlet, a thrust tube, an impeller system, and an outlet. The inlet location of the tube may be placed on the bottom surface of the surfboard after the widest point of the surfboard and may have an outlet at the rear fin location; in some embodiments, the outlet may be placed before the fins. The impeller system may be comprised of a turbine and stator, the turbine may have a fixed or variable pitch and may rotate at various rpm, the stator is operable for redirecting the flow out of the turbine. The thrust tube may have a diameter that is slightly larger than the turbine diameter and may have an outlet nozzle with a fixed direction, further the tube interior surface may comprise of guide vanes of varying geometry, which assist in changing the direction of flow. The inlet of the thrust tube may have a closing door mechanism that may close off the inlet allowing the system to reduce drag when the system is not on. The inlet may have a screen and filter to prevent debris from ocean water from entering the system and damaging the turbine and obstructing flow.

In some embodiments of the present invention, the motorized surfboard further comprises a system that is operable to monitor the heading and orientation of the surfboard an accelerometer may determine if the surfboard has capsized and may kill the power to the motors.

DETAILED DESCRIPTION

Figure 1:
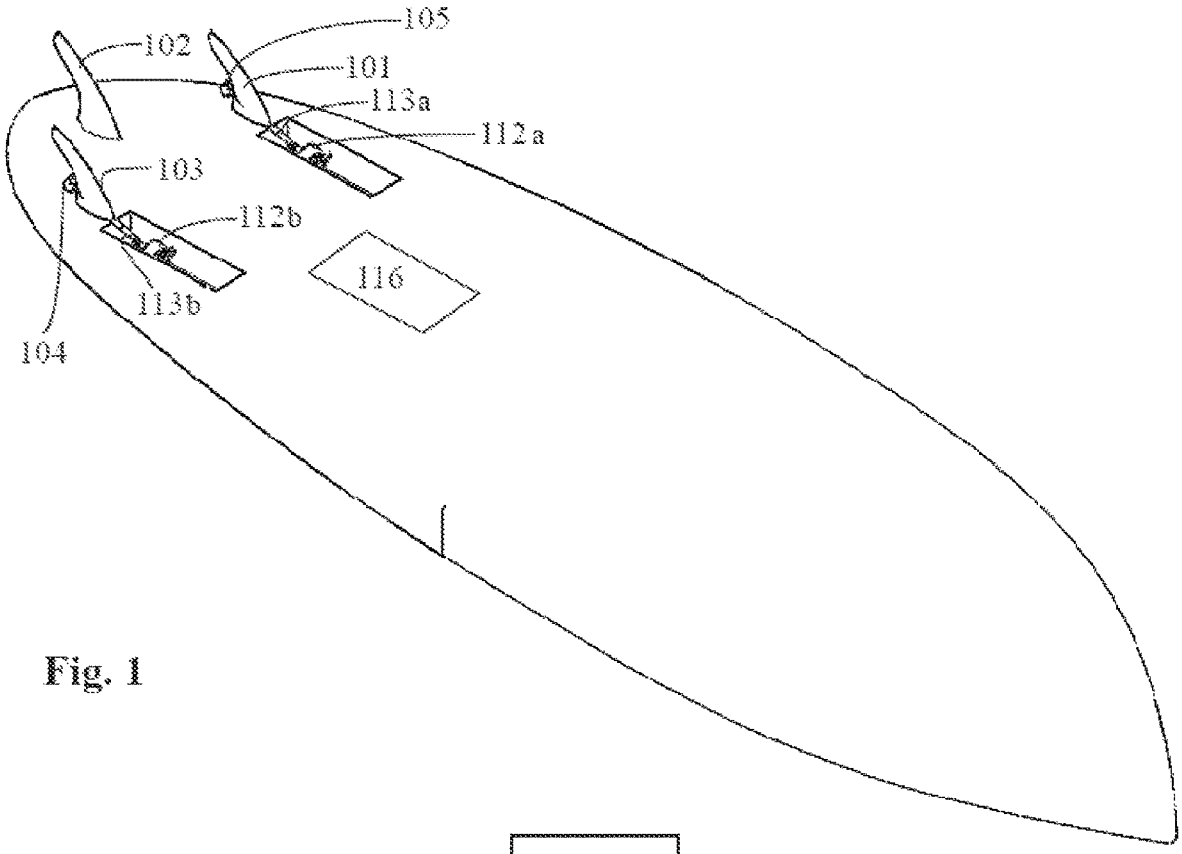
FIG. 1 shows a bottom trimetric view of a motorized surfboard according to an embodiment of the present invention.
Figure 2:
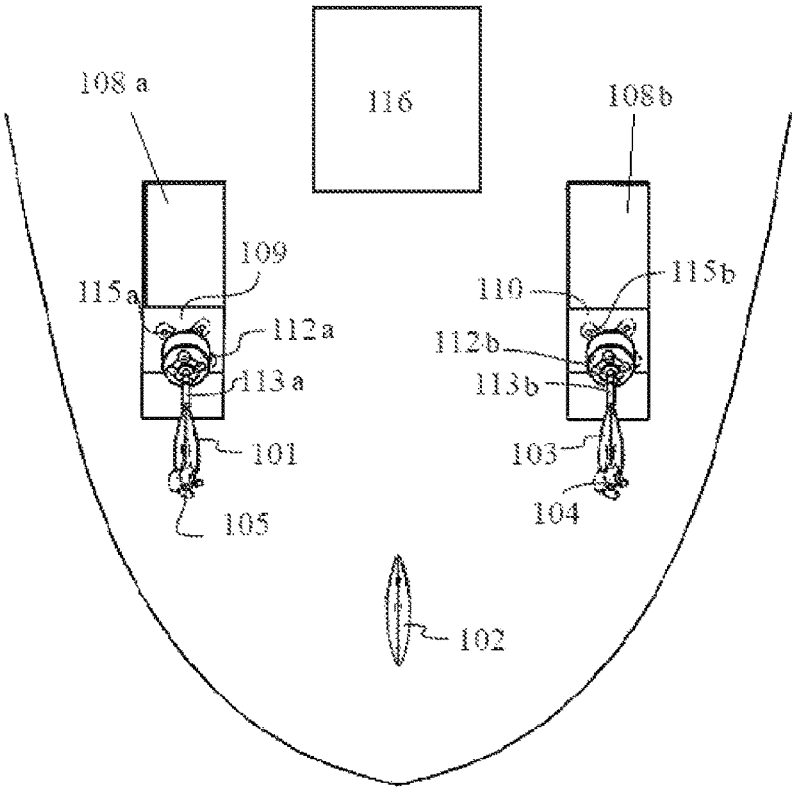
FIG. 2 shows a cut-out of the bottom view of a motorized surfboard according to an embodiment of the present invention.

References will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. However, it will be apparent to one skilled in the art that the present invention may be practiced without these specific details.

Referring to the drawings wherein like reference characters designate like or corresponding parts throughout the several views, and referring particularly to FIGS. 1-9, it is seen that the present invention includes various embodiments of the motorized surfboarding device, systems using the same, and methods of using the same.

The motorized surfboarding device 100 of FIGS. 1-5, according to the an embodiment of the present invention. Device 100 comprises a surfboard with fins 101, 102, and 103 operable for a rider to direct the surfboard. The fin 101 is operable to house a shaft 113*a,* which may be fixedly attached to a propeller blade 105, the shaft 113*a* may rotate with a DC motor 112*a* which receives power from a battery system 108*a*. The fin 103 is operable to receive a shaft 113*b,* which may be fixedly attached to a propeller blade 104 and may rotate with a DC motor 112*b* that receives power from a battery system 108*b,* as shown in the exemplary view of FIG. 1. The DC motors 112*a* and 112*b* may be secured with fasteners via brackets 115*a* and 115*b,* respectively, to the surfboard to the mounting locations 109 and 110.

A system control circuitry 116 is operable to regulate and direct the power of the system and may contain various sub-circuits. The subcircuits may be comprised of a microcontroller, accelerometer, a brushless motor speed controller (e.g., ESC), and Bluetooth compatible device. The accelerometer may be operable to determine the orientation and heading of the surfboard and enables the controller to identify the event of a capsized surfboard, which may intermittently cut power to the electric motors 112*a* and 112*b*. The speed controller may be operable to determine the rpm speed of the DC motors 112*a* and 112*b* and regulate a manual speed input at the motors 112*a* and 112*b* (e.g., by an analog speed dial controller) or speed input from a handheld controller 117. The speed of the motors may correspond to a voltage input from the brushless motors 112*a* and 112*b,* where the voltage input may be a ramp signal corresponding to the remaining voltage in the batteries 108*a* and 108*b*.

In embodiments that include a handheld controller 117, the controller 117 is operable to wirelessly send a command to the system control circuitry 116 to increase the speed of the DC motor from input from button 118. The capacitance of the system may be displayed to the user from LEDs 119 on the handheld controller 117 to the operator. The location 120 is a charging port to charge an internal battery; the charging port may be of a common micro dongle type (e.g., universal serial bus, type-c, etc.). In another embodiment, a handheld controller may display the capacitance of the system with an LED screen.

Figure 3:
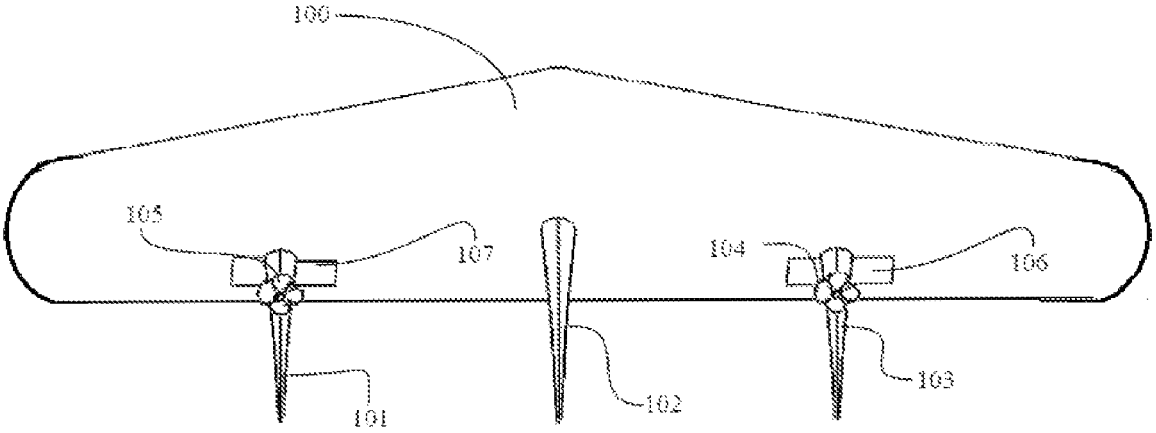
FIG. 3 shows a rear view of a motorized surfboard according to an embodiment of the present invention.
Figure 4:
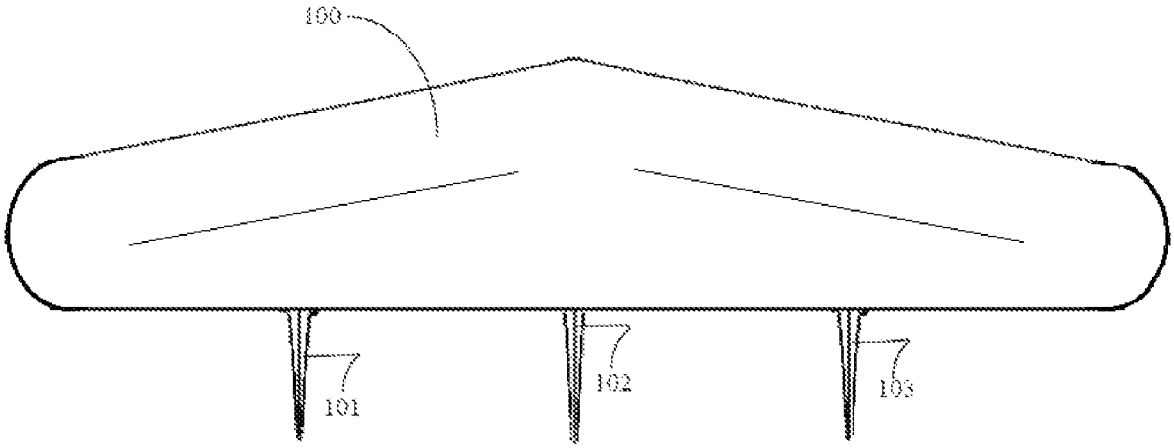
FIG. 4 shows a front view of a motorized surfboard according to an embodiment of the present invention.
Figure 5:
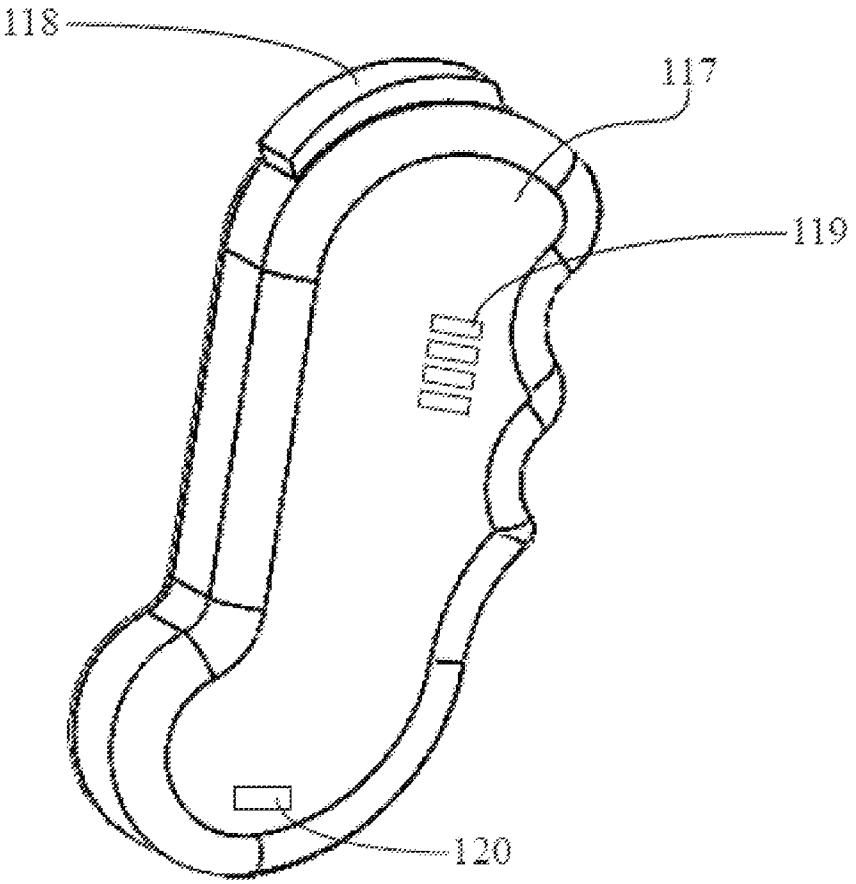
FIG. 5 shows a perspective view of a motorized surfboard hand controller according to an embodiment of the present invention.

FIG. 3 shows an exemplary rear view of the motorized surfboard of FIG. 1, device 100. The motorized surfboard may have fins 101, 102, and 103, where fins 101 and 103 are capable of supporting a shaft that may rotate propellers 104 and 105. The plates 106 and 105 are operable to have a watertight seal and protect the battery and motor from the environment. FIG. 4 shows a front view of the device of FIG. 1. The watertight seal may be comprised of O-rings or a gasket to seal the system from the environment.

Device 100 is assisting a rider in overcoming the surf zone when staging for a ride. The device offers a low-profile method of propulsion, which still enables the feel and control of a conventional surfboard.

Figure 7:
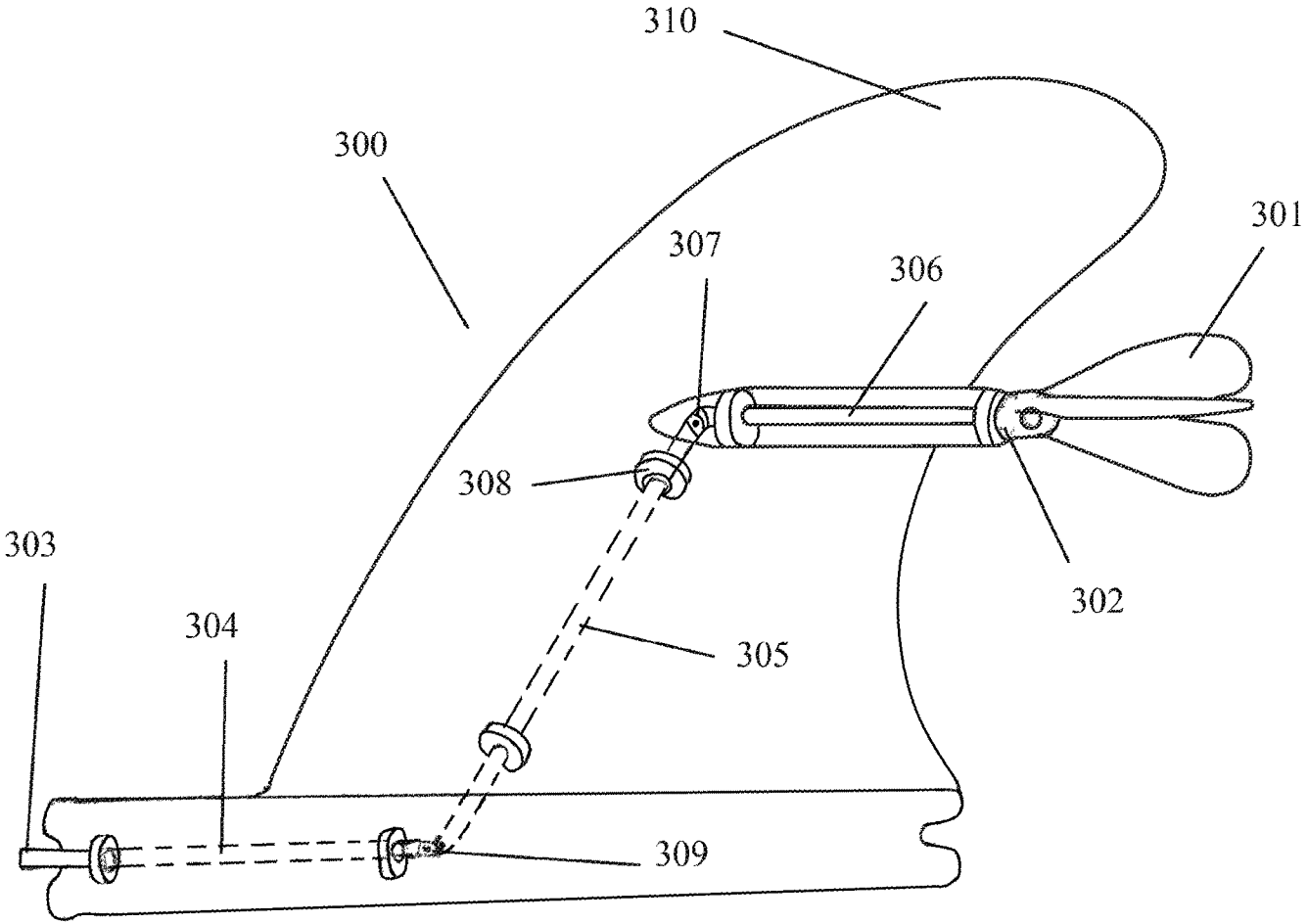
FIG. 7 shows a rear view of a motorized surfboarding according to an embodiment of the present invention.
Figure 6:
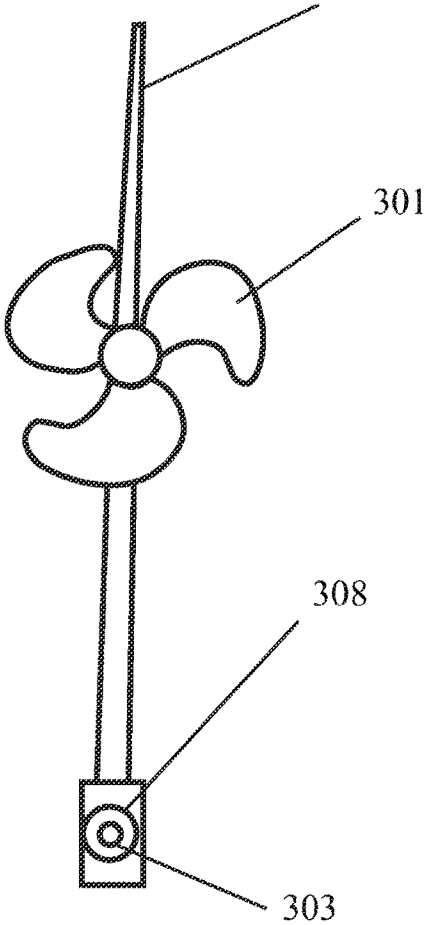
FIG. 6 shows a side view of a motorized surfboard according to an embodiment of the present invention.
Figure 8:
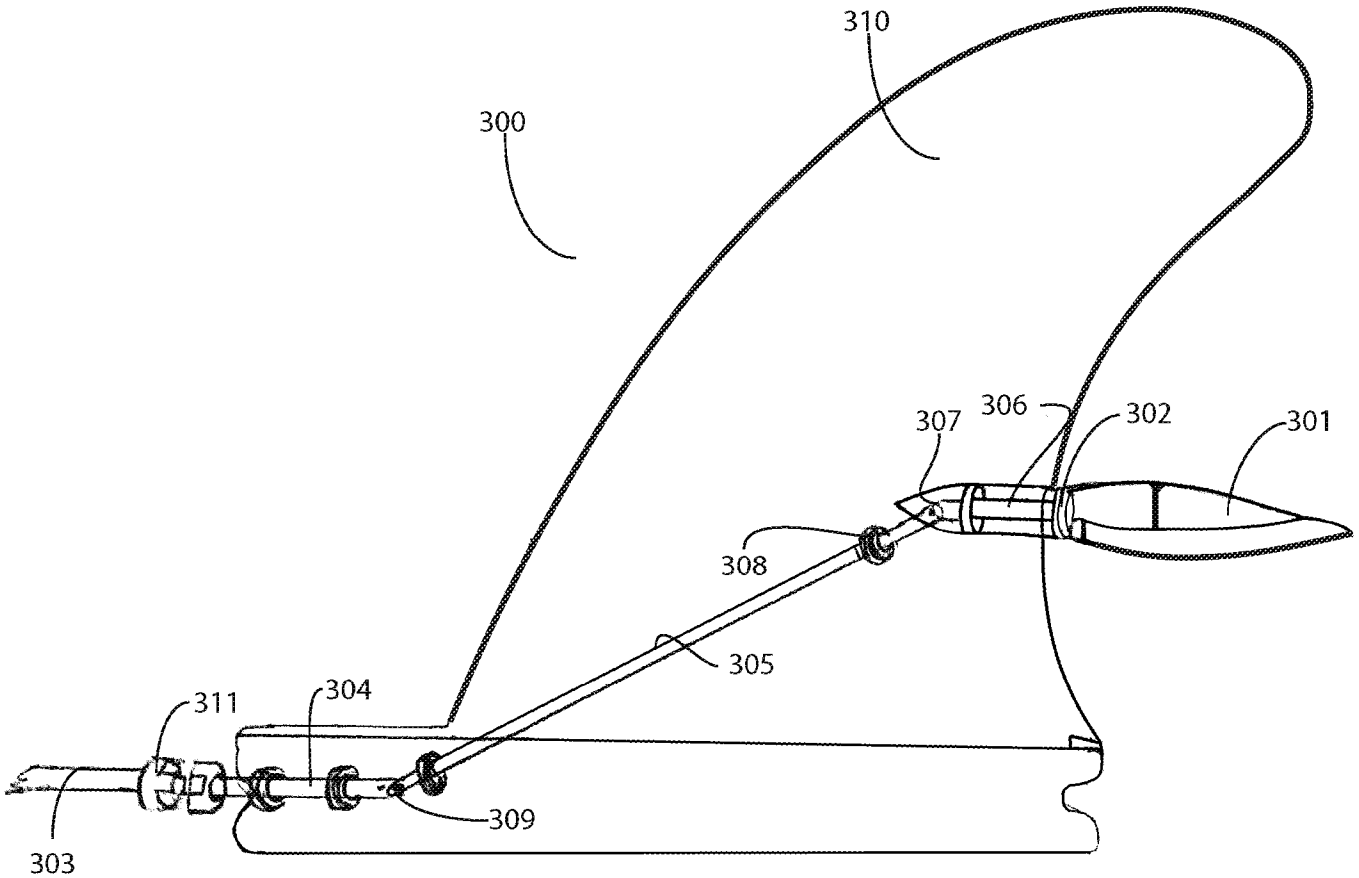
FIG. 8 shows a cross-sectional view of a motorized surfboard according to an embodiment of the present invention.

FIG. 6-8 shows an embodiment of a low-profile motorized surfboarding device 300 with another propeller propulsion system. FIG. 7 shows a frontal view of the fin 310, collapsible propeller 301, the input shaft 303, and bearing 308. The input shaft 303 and bearings 308 are in line with the centerline of the fin 310 and propeller 301. The input shaft 303 may be operable to connect to a clutch system, which may allow for free rotation and disengage the engine and propeller 301. The bearings may be of the sealed or unsealed type and are placed at various locations within the powertrain system. The propeller 301 is shown in it's expanded form, which facilitates propulsion. The mounting location of the propeller 301 may be mount at various locations along the fin 310. The collapsible propeller 301 may have blades with a geometry operable to fold into a prolated lemon-like spheroid shape, which is aerodynamic shape and functions to prevent additional drag from acting on the system.

FIG. 7 shows an interior side view of the low-profile motorized surfboarding device of FIG. 6. The fin 310 is operable to enclose various shafts bearings and bushings, which allow for the rotation of the collapsible propeller 301; the propeller in FIG. 7 is shown in the semi-collapsed state. The input shaft 303 may rotate about the central axis of the shaft and may turn in a clockwise or counterclockwise direction, and the DC-motor may determine the direction of rotational motion as in previous embodiments. The input shaft 303 joined to an internal shaft 304 is supported with a bearing 308 and is connected to a lateral shaft 305, which is operable to translate the rotation motion to a prop drive shaft 306, which may then turn the collapsible propeller 301 in the desired rotation. The joining mechanism for the internal shaft 304 and the lateral shaft 305 may be a U-joint mechanism 309, and similarly, the joining location for the lateral shaft 305 and the prop drive shaft 306 may be a U-joint 307. The lateral shaft 305 may be supported with a bearing 308, which may be of the thrust bearing type. The propeller 301 may be collapsed at the location 302 using an additional motor or may utilize a gear train which may collapse the system when the configuration may rotate in a direction that opposes thrust. The shafts may be composed of various materials. In some embodiments, the u-joints 307 and 309 may utilize a gear (e.g., bevel gears, spiral bevel gears, etc.) to translate the motion from each shaft. In some embodiments, the input shaft 303 may have a clutch and thrust mechanism to join with the DC motor.

FIG. 8 shows another interior side view of the low-profile motorized surfboarding device of FIG. 6. The collapsible propeller 301 shown is in its fully collapsed form. The input shaft 303 may join the DC motor with a dog clutch system 311, which may be operable to engage and disengage the propeller drive system. The dog clutch system 311 may have a synchromesh-type system to facilitate the teeth from both shafts lining up to allow for smooth engagement and disengagement of the system.

Figure 9:
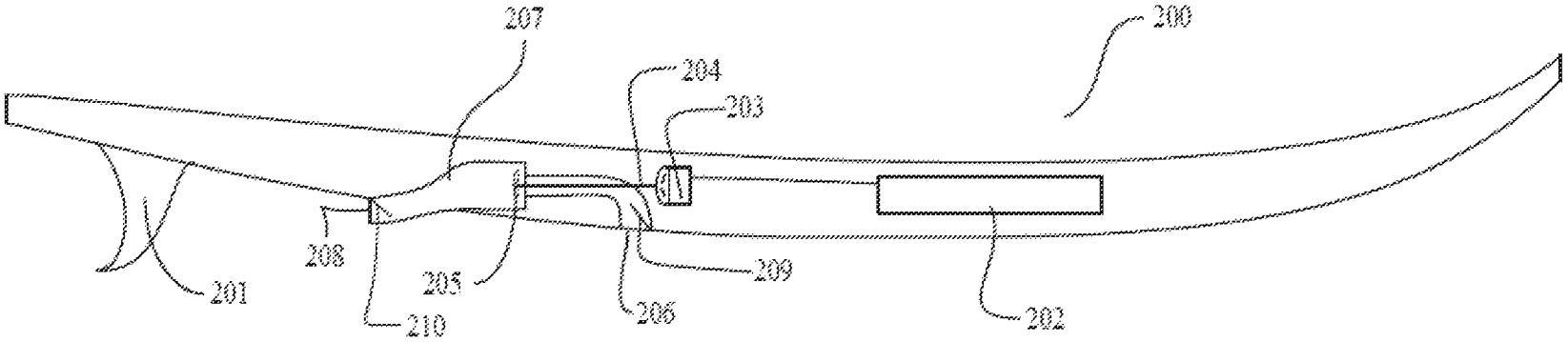
FIG. 9 shows a side view of a motorized surfboarding device according to an embodiment of the present invention.

The motorized surfboard device 200 of FIG. 9 shows a side view of another embodiment of the present invention. The motorized surfboard 200 may have a waterjet propulsion system that is largely interior to the surfboard. The system may have a fin 201, battery and control circuitry 202, and a DC electric motor 203. The motor is operable to turn a shaft 204, and which may turn a turbine rotor and stator 205, the inlet 206 is operable to feed a volume of water through a channel to the turbine rotor and stator 205. The thrust tube 207 may have a geometry such that the fluid may follow a vane path without resistance to flow. A thrust nozzle 208 may have a fixed geometry operable to generate a propulsive force and facilitate the rider in moving the surfboard. An inlet flap 209 is operable to close off the flow of fluid when the rider is prepared to ride the wave through the surf. Additionally, an outlet flap 210 may be operable to slow down the speed of the device by actuating the outlet flap and choking the device, while the motor voltage is simultaneously cut-off. The control circuitry 202 may have a battery storage system, ESC, accelerometer, and various servo motors. The servo motors are operable to actuate the inlet and outlet flaps to the desired positions. The system may be controlled with the handheld control of device 100 shown in FIG. 5. The location of the outlet may be adapted to fit at various locations along with the bottom panel.

CONCLUSION/SUMMARY

The present invention provides a novel and improved motorized surfboard device operable to assist a rider in overcoming the surf and staging for a ride. It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed:

1. A motorized surfboard comprising:

a. a surfboard body having an interior cavity for storing electrical power and circuitry;

b. at least one electro-mechanical motor and collapsible propeller assembly, wherein the electro-mechanical motor may be disengaged from the collapsible propeller assembly;

c. a power control system operable to electrically control said motor and propeller assembly; and d. a handheld controller operable to wirelessly control the system.

2. The motorized surfboard as in claim 1, wherein the body is comprised of an interior material and an outer skin.

3. The motorized surfboard as in claim 1, wherein the electrical power may be stored in a battery.

4. The motorized surfboard as in claim 1, wherein the circuitry is operable to regulate power discharge to the electro-mechanical motor.

5. The motorized surfboard as in claim 1, wherein the electro-mechanical motor is a DC motor rated to operate up to 500 watts.

6. The motorized surfboard as in claim 5, wherein the motor is nested in the interior material of the body and is operable to turn a propeller via a shaft.

7. The motorized surfboard as in claim 6, wherein the shaft passes through a fin and has a propeller fixedly attached to said shaft.

8. The motorized surfboard as in claim 1, wherein the power control system is operable to communicate with a controller.

9. The motorized surfboard as in claim 1, wherein the collapsible propeller assembly is operable to fold into an aerodynamic shape.

10. A motorized surfboard comprising:

a. a surfboard body having an interior cavity for storing electrical power circuitry;

b. an at least one electro-mechanical motor and collapsible impeller assembly;

c. a power control system operable to electrically control said motor and propeller assembly; and d. a handheld controller to wirelessly control the electric power circuitry.

11. The motorized surfboard as in claim 10, wherein the body is comprised of an interior material and an outer skin.

12. The motorized surfboard as in claim 10, wherein the interior cavity may store the circuitry and battery system and is operable to protect the components from environmental elements.

13. The motorized surfboard as in claim 10, wherein the electro-mechanical motor is a brushless DC, which may be rated to operate up to 500 watts.

14. The motorized surfboard as in claim 10, wherein the body may have a storage compartment operable to receive said impeller and motor system.

15. The motorized surfboard as in claim 10, wherein the collapsible impeller is attached adjacently to the rails and parallel to the stringer.

16. The motorized surfboard as in claim 10, wherein the impeller is nested inside a volute and is operable to compress a fluid for developing thrust.

17. A motorized surfboard comprising:

a. a surfboard body having an interior cavity for storing electrical power and circuitry;

b. at least one electro-mechanical motor and collapsible propulsion assembly, wherein mechanical connections operable tothat translate motion from the electro-mechanical motor to said collapsible propulsion device are positioned within a fin of said surfboard, said collapsible propulsion assembly being rotatably connected at or near the rear aspect of said fin;

c. a power control system operable to electrically control said motor and propeller assembly; and d. a handheld controller operable to wirelessly control the system.

18. The motorized surfboard as in claim 1, wherein the said collapsible propulsion assembly protrudes from a posterior side of said fin.

19. The motorized surfboard as in claim 1, wherein a propeller drive shaft of said collapsible propulsion assembly is mechanically connected to a rotatable shaft at least partially embedded in said fin.

20. The motorized surfboard as in claim 17, wherein the electro-mechanical motor may be disengaged from the collapsible propeller assembly.

* * * * *